US006202621B1

(12) United States Patent
Inumaru et al.

(10) Patent No.: US 6,202,621 B1
(45) Date of Patent: Mar. 20, 2001

(54) FOUR-CYCLE ENGINE LUBRICATION STRUCTURE

(75) Inventors: Nobuaki Inumaru; Kouichi Tsutsumi; Yasuo Shimura; Osamu Kudou, all of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/392,480

(22) Filed: Sep. 9, 1999

(30) Foreign Application Priority Data

Sep. 12, 1998 (JP) ..... 10-276594

(51) Int. Cl.[7] ..... F01M 1/02
(52) U.S. Cl. ..... 123/196 R
(58) Field of Search ..... 123/196 R, 196 M, 123/317, 73 V, 196 CP; 184/6.2, 13.1

(56) References Cited

U.S. PATENT DOCUMENTS 5,456,230 * 10/1995 VanRens et al. ..... 123/317
5,960,764 * 10/1999 Araki ..... 123/196 R
5,975,042 * 11/1999 Aizawa et al. ..... 123/196 M

FOREIGN PATENT DOCUMENTS 6-25527 4/1994 (JP) .

* cited by examiner

*Primary Examiner*—Noah P. Kamen
*Assistant Examiner*—Hyder Ali
(74) *Attorney, Agent, or Firm*—Birch, Stewart, Kolasch & Birch, LLP

(57) ABSTRACT

An oil sump for lubricating oil is provided at a lower part of a crank chamber of a dry sump-type four-cycle engine. A reed valve is provided at an outlet of the oil sump which opens when pressure in the crank chamber is high. Furthermore, an oil passage slopes upwards from the outlet of the oil sump, with an outlet of the oil passage being provided above an oil surface level of oil accumulated within the engine. Oil from the outlet of the oil passage is smoothly discharged from the outlet of the oil passage without being discharged into the collected oil. Furthermore, oil mixed with air within the crank chamber is not directly mixed into the collected oil and oil oxidation is therefore prevented. Since there is no direct contact with high-temperature blow-by gas, etc., oil deterioration is suppressed.

24 Claims, 10 Drawing Sheets

FOUR-CYCLE ENGINE LUBRICATION STRUCTURE

BACKGROUND OF THE INVENTION

1. Field of the Invention

The present invention relates to an improvement to a four-cycle engine lubrication structure.

2. Description of Related Art

Four-cycle engine lubrication structures such as, for example, the "Four-cycle Engine Lubrication Apparatus" of Japanese Patent Publication No. Hei. 6-25527 are well known.

The above technology relates to a four-cycle engine lubrication apparatus capable of preventing drops in output accompanying engine oil agitation and capable of reliably providing oil to each of the necessary places within the engine even when the vehicle is at an incline. As shown in FIG. 2 of the above publication, there is provided a crank chamber 12, a transmission chamber 13 separated from the crank chamber 12 by a bulkhead 14, a through hole 15 provided at the bulkhead 14 to allow the crank chamber 12 and the transmission chamber 13 to communicate, and a unidirectional valve 16 provided at the through hole 15 for allowing oil to flow only from the crank chamber 12 to the transmission chamber 13.

In the above technology, when the pressure within the crank chamber 12 becomes high, the unidirectional valve 16 opens and oil within the crank chamber 12 flows through the through hole 15 to the transmission chamber 13. However, oil is collected at a position higher than the through hole 15 within the transmission chamber and this may hinder opening of the valve 16. Therefore, the oil does not move smoothly from the crank chamber 12 to the transmission chamber 13.

There is also an problem in the above technology, since air becomes mixed with the oil within the crank chamber 12. Therefore, when the oil flows into the transmission chamber 13, air is mixed in with the oil within the transmission chamber 13 and the oil is oxidized, causing increased deterioration of the oil.

SUMMARY OF THE INVENTION

It is therefore an object of the present invention to provide a four-cycle engine lubrication structure capable of smoothly discharging oil from the crank chamber and suppressing oil deterioration.

In order to achieve the aforementioned object, a first aspect of the present invention includes an oil sump for lubricating oil provided at a lower part of a crank chamber of a dry sump-type four-cycle engine, a reed valve provided at an outlet of the oil sump and opening when crank chamber pressure is high, and an oil passage extending at an incline upwards from the outlet of the oil sump, with an outlet of the oil passage being provided above an oil surface level of oil accumulated within the engine.

Since the oil passage outlet is provided higher than the surface level of oil that has accumulated within the engine, oil coming from the oil passage outlet is not discharged within the collected oil. Therefore, discharge of oil from the oil passage outlet can be carried out smoothly. Oil mixed with air within the crank chamber is not directly mixed with collected oil. Therefore, oil oxidation is prevented. Furthermore, the oil is substantially protected against deterioration because there is no direct contact between the oil and hot blow-by gas, etc.

According to a second aspect of the present invention, projections are formed on the crank chamber inner wall at the inlet of the oil sump in such a manner as to project along the outer periphery of the crankshaft weight in an opposite direction to the direction of rotation of the crankshaft weight. The projections come into contact with the outer periphery of the crankshaft weight. Therefore, oil on the crankshaft weight is removed by the projections, causing the oil to flow rapidly to the oil sump. Accordingly, discharge of oil from the crank chamber is made easier as a result.

According to a third aspect of the present invention, an oil chamber is provided for separating and recovering oil from oil mist discharged from the oil passage outlet.

Since oil is separated and recovered from the oil mist at the oil chamber, air bubbles are no longer mixed with the recovered oil. Therefore, oil deterioration is prevented and oil provided to each part of the engine can be effectively utilized. Furthermore, the oil passage outlet is protected and oil is more effectively discharged from the crank chamber.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

The following is a description based on the appended drawings of an embodiment of the present invention. The drawings are to be viewed in the direction of the numerals.

Figure 1:
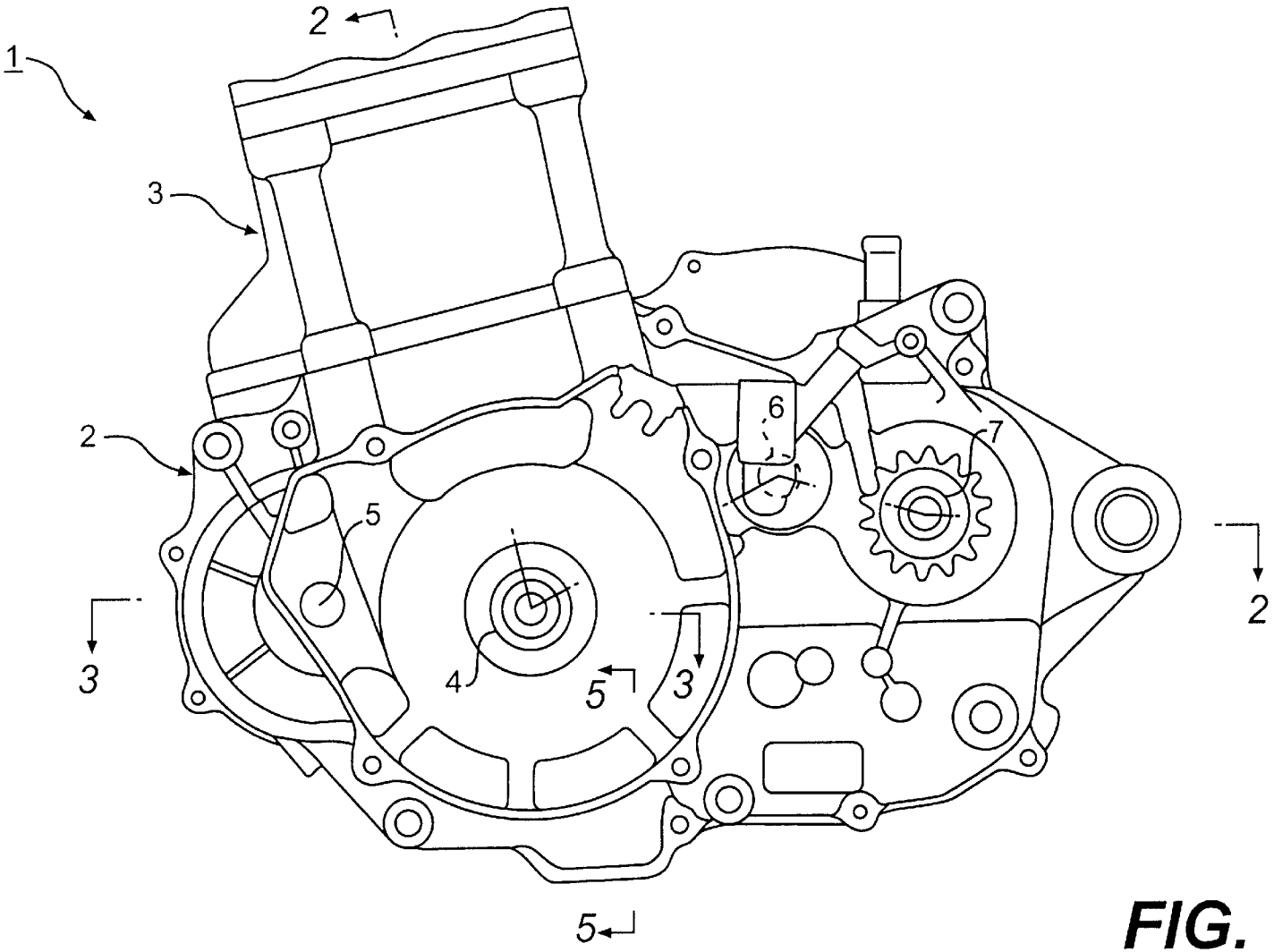
FIG. 1 is a side view of one side of an engine to which the four-cycle engine lubrication structure of the present invention is applied.

FIG. 1 is a side view of one side of an engine adopting the lubrication structure for a four-cycle engine of the present invention. For ease of description, an AC generator attached to an end of a crankshaft and a cover thereof, and a transmission-side cover are taken off.

The engine 1 is equipped with a crankcase section 2 and a cylinder block 3. The crankcase section 2 houses a crankshaft 4, a balancer shaft 5 arranged at the front of the crankshaft 4, and a main shaft 6 and counter shaft 7 arranged on the transmission side at the rear of the crankshaft 4 in such a manner that the shafts are rotatable.

Figure 2:
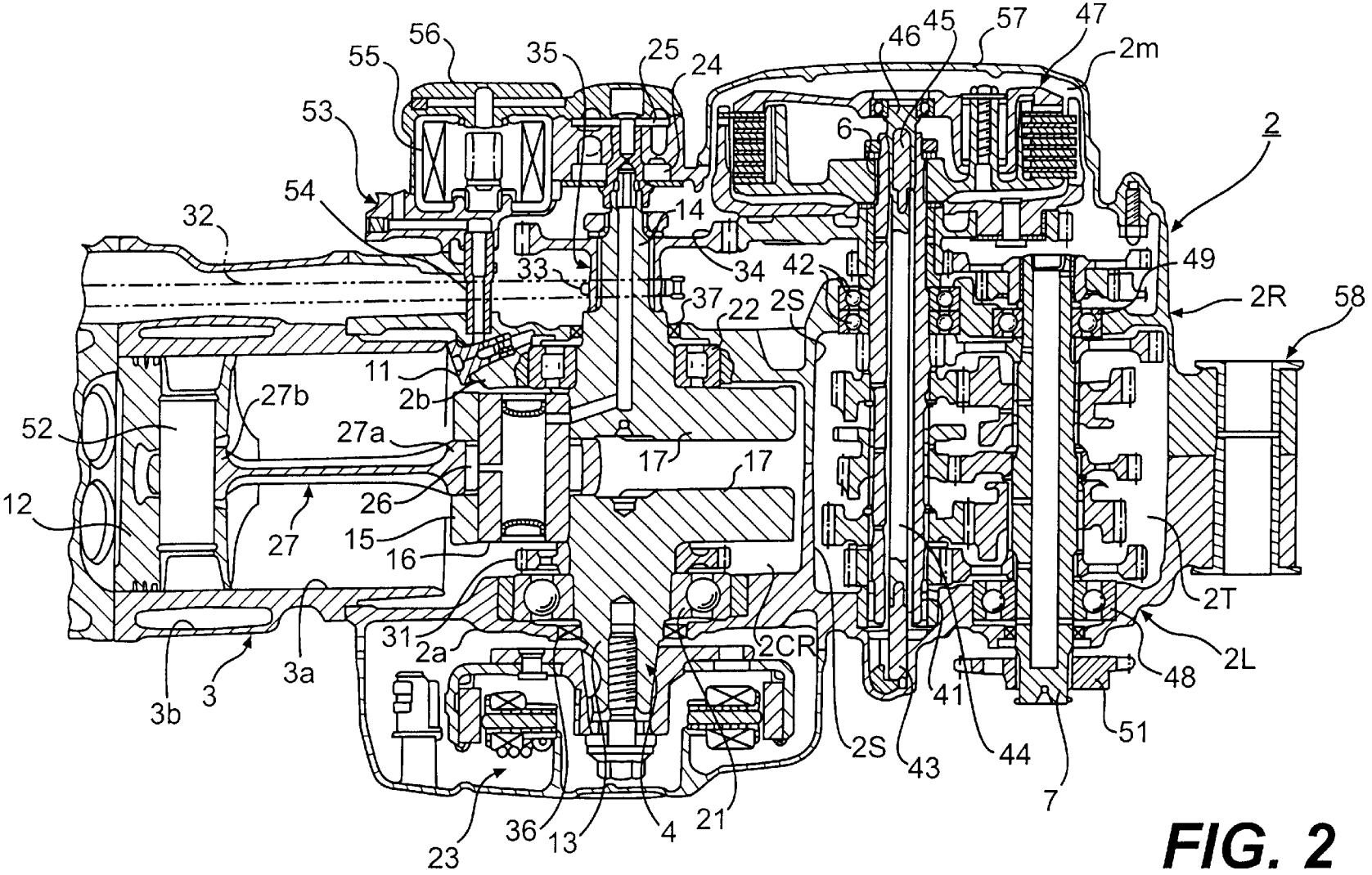
FIG. 2 is a cross-section taken along line 2—2 of FIG. 1.

FIG. 2 is a cross-section taken along line 2—2 of FIG. 1. The crankcase section 2 is a combination of crankcases 2L and 2R, and is partitioned into a sealed crank chamber 2CR and a transmission chamber 2T by bulkheads 2S and 2S.

The crankcase 2L is equipped with a first main bearing section 2*a* for attaching the crankshaft 4. The crankcase 2R is equipped with a second main bearing section 2*b* for attaching the crankshaft 4. An oil jet nozzle 11 for cooling the piston to be described later is attached at the cylinder block 3 of the second main bearing section 2*b*.

The cylinder block 3 is a water-cooled type where a piston 12 is movably inserted into a cylinder portion 3*a,* and cooling water is supplied to a water jacket 3*b*.

The crankshaft 4 comprises first and second shaft sections 13 and 14, a crank portion 15 connecting the first and second shaft sections 13 and 14, a crank pin 16 attached to the crank portion 15, and counterweights 17 and 17 provided at the first and second shaft sections 13 and 14 on the opposite side of the crank portion 15 with respect to the axial center of the first and second shaft sections 13 and 14.

The crankshaft 4 is attached in a rotatable manner to the crankcase 2L via a radial ball bearing 21 and to the crankcase 2R via a radial roller bearing 22, with an AC generator 23 for generating electricity being attached to one end thereof and a first oil pump 24 and a second oil pump 25 for dry sump lubrication being attached to the other end thereof A big end 27*a* of a connecting rod 27 is attached in such a manner as to be capable of being rotated by the crank pin 16 via a bearing 26. A balancer shaft driving gear 31 for driving the balancer shaft 5 (refer to FIG. 1) is fitted around the first shaft section 13. A gear member 35 equipped with a cam shaft drive gear 33 for driving a cam shaft (not shown) via a chain 32 and a main shaft drive gear 34 for driving the main shaft 6 on the transmission side is attached to the second shaft portion 14. Numeral 36 and numeral 37 represent oil seals for preventing oil from leaking out from the crank chamber 2CR.

The main shaft 6 is attached to the crankcase 2L via a bearing 41 and to the crankcase 2R via bearings 42 and 42 in such a manner as to be capable of being rotated. The main shaft 6 also houses a first rod 43, second rod 44, third rod 45 and fourth rod 46 that are capable of moving in the axial direction. A clutch 47 is spline fitted to the outer periphery of one end thereof with a plurality of spline fitted drive gears being attached at the outer periphery thereof in such a manner as to be movable in the axial direction.

The first rod 43, second rod 44, third rod 45 and fourth rod 46 engage and disengage the clutch 47 as a result of movement in the axial direction so as to control transmission of driving force from the crankshaft 4 to the main shaft 6.

The counter shaft 7 is rotatably attached to the crankcase 2L via a bearing 48 and to the crankcase 2R via a bearing 49. The counter shaft 7 has a plurality of driven gears meshing with the drive gears of the main shaft 6 at the outer periphery thereof and is capable of moving in an axial direction. The counter shaft 7 also has a drive sprocket 51 for driving a wheel (not shown) using a chain (not shown) attached to an end thereof.

The piston 12 is attached to a small end 27*b* of the connecting rod 27 via a piston pin 52 in such a manner as to be rotatable.

In FIG. 2, numeral 53 indicates a case side cover attached to the side of the crankcase 2R, numeral 54 indicates a coupling pipe for coupling the case side cover 53 and the second main bearing section 2*b* of the crankcase 2R, numeral 55 indicates an oil filter, numeral 56 indicates an oil filter cover, numeral 57 indicates a cover covering the outer side of the clutch 47, and numeral 58 indicates an attachment section for attaching the engine (refer to FIG. 1) to a vehicle frame (not shown).

Figure 3:
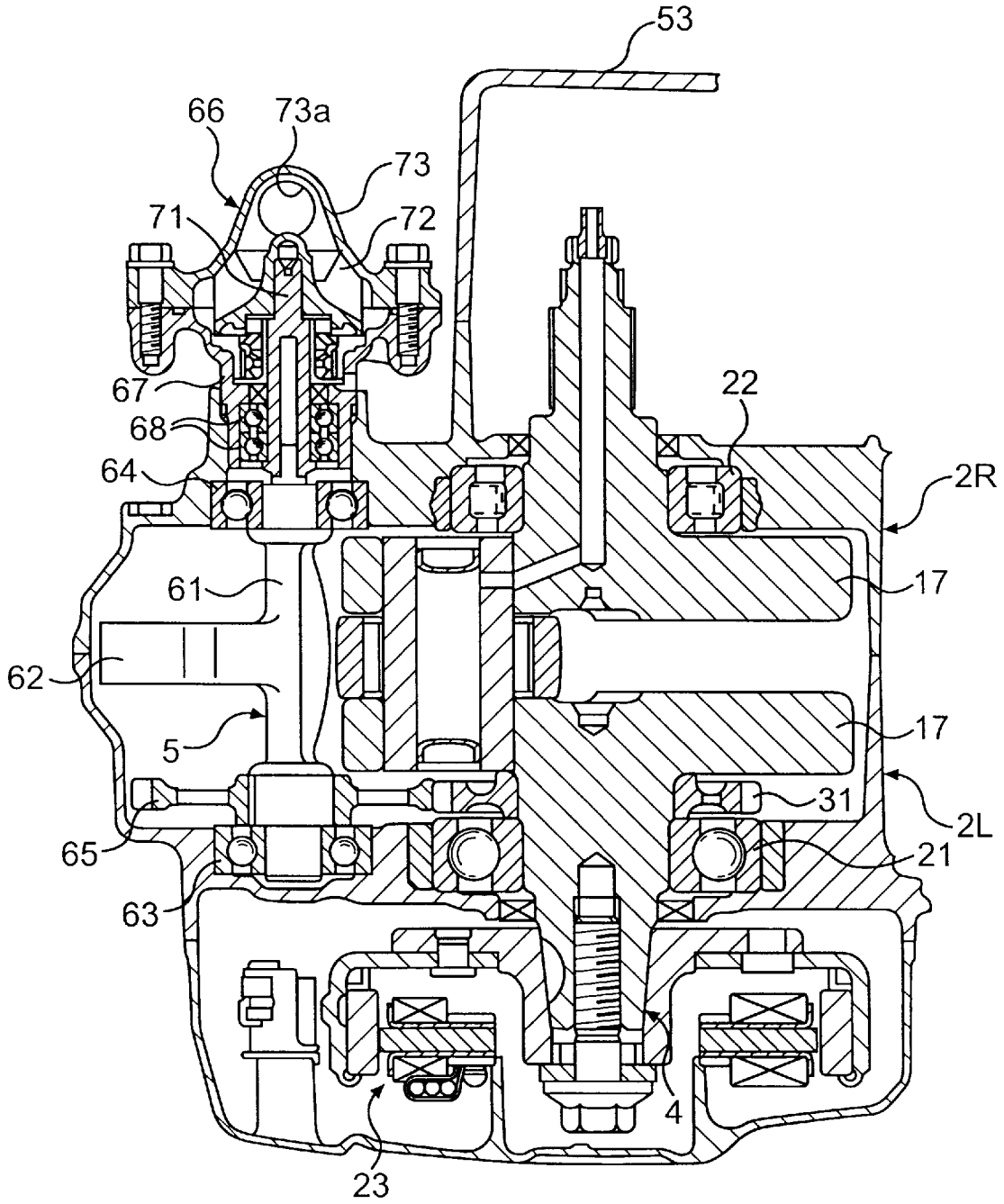
FIG. 3 is a cross-section taken along line 3—3 of FIG. 1.

FIG. 3 is a cross-section taken along line 3—3 of FIG. 1. The balancer shaft 5 comprises a shaft section 61 and a weight 62 provided at the center of the shaft section 61. The balancer shaft 5 rotates at a speed equal to the speed of the crankshaft 4 in a direction opposite to that of the crankshaft 4 in order to suppress engine oscillations. The balancer shaft 5 is rotatably attached to the crankcase 2L via a bearing 63 and to the crankcase 2R via a bearing 64. In the balancer shaft 5, the shaft section 61 has driven gears 65 at one end thereof, and is coupled, at the other end thereof at the side of the bearing 64, with a water pump 66 for circulating cooling water. The driven gears 65 mesh with the balancer shaft drive gears 31 that interlock with the crankshaft 4 at the shaft section 61.

The water pump 66 comprises a base section 67 attached to the side of the crankcase 2R, a rotation shaft 71 attached to the base section 67 via bearings 68 and 68 in such a manner as to be rotatable and coupled with the balancer shaft 5, an impeller 72 attached to the rotation shaft 71 and a case section 73 housing the impeller 72 and being attached to the base section 67. An inlet port 73*a* is provided at the case section 73.

Figure 4:
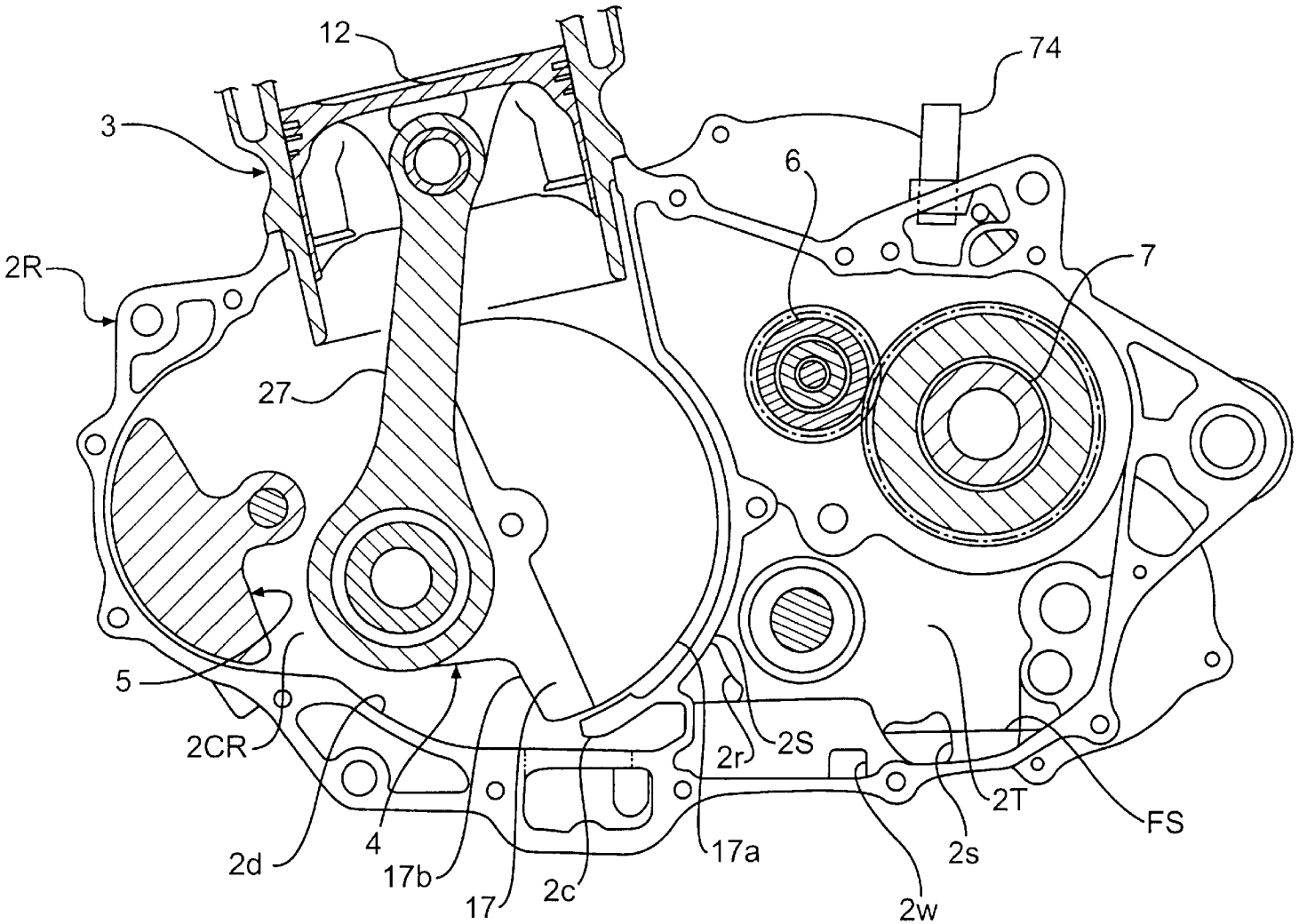
FIG. 4 is a cross-section of the four-cycle engine lubrication structure of the present invention.

FIG. 4 is a cross-section of a four-cycle engine of the present invention, specifically showing an area that combines the crankcase 2L (refer to FIG. 2) and the crankcase 2R.

The crankcase 2R is equipped with a projection 2*c* formed so as to come into contact with the outer surface 17*a* of the counterweight 17 at the bulkhead 2S. The projection 2*c* constitutes an inner wall which removes oil attached to the outer surface 17*a* of the counterweight 17. Numeral 2*d* indicates a wall surface within the crank chamber 2CR, numeral 17*b* indicates a linear portion of the counterweight 17 and numeral 74 indicates a reserve pipe.

Although not shown in the drawings, the crankcase 2L is also equipped with a projection 2*c* formed at the bulkhead 2S and a wall surface 2*d* substantially the same as in the crankcase 2R.

Figure 5:
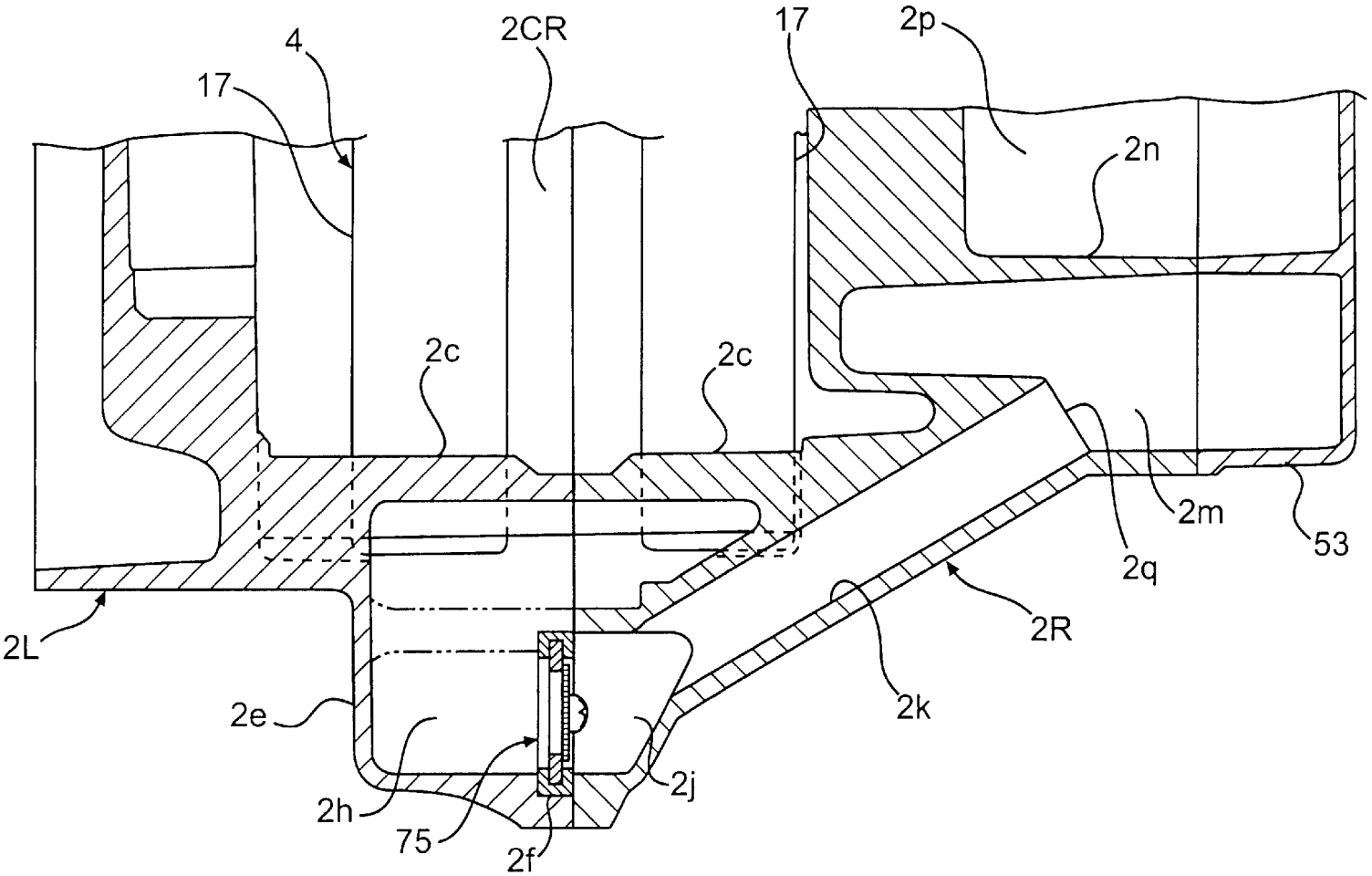
FIG. 5 is a cross-section taken along line 5—5 of FIG. 1.

FIG. 5 is a cross-section taken along line 5—5 of FIG. 1. The crankcases 2L and 2R are equipped with a reed valve 75 constituting a unidirectional valve at the position where the crankcases 2L and 2R are combined so that oil flows from the side of the crankcase 2L to the side of the crankcase 2R.

Namely, a raised portion 2*e* is formed in the lower part of the crankcase 2L and the reed valve 75 is fitted into a stepped portion 2*f* formed in the surface opposite the raised portion 2*e* so as to press against the crankcase 2R.

Ease of assembly is enhanced because the reed valve 75 is provided at opposing portions of the crankcases 2L and 2R. Furthermore, the positioning of the reed valve 75 at substantially the center of the width of the engine 1 of the engine 1, i.e. the center of the vehicle width (refer to FIG. 1 ) is advantageous with respect to fluctuations in the oil surface due to the inclination of the vehicle. Therefore, oil discharge can be improved.

The crankcase 2L is equipped with an oil sump 2*h* formed by the raised portion 2*e* and the reed valve 75. The crankcase 2R is equipped with an oil inflow chamber 2*j* for allowing oil to flow into from the oil sump 2*h* via the reed valve 75, an oil passage 2*k* sloping upwards from the oil inflow chamber 2*j*, an oil chamber 2*m* provided at an outlet 2*q* of the oil passage 2*k* and a cover 2*n* provided above is the oil chamber 2*m*.

The oil chamber 2*m* reduces the flow speed of the oil mist and separates and collects oil from the oil mist by discharging the oil mist generated within the crankcase section 2 (refer to FIG. 2) from the outlet 2*q* of the oil passage 2*k*.

Air bubbles are preventing from being mixed with the collected oil, oil deterioration is prevented, and oil supplied to each part of the engine can be utilized in an effective manner by the oil chamber 2*m*. Furthermore, the oil passage outlet is protected and oil is discharged from the crank chamber in a more effective manner.

Oil mist remaining in the oil chamber 2*m* passes together with air through the case side cover 53 (refer to FIG. 2) and passes within the crankcase 2R to be sent from the reserve pipe 74 (refer to FIG. 4) to a carburetor (not shown).

The cover 2*n* is provided to ensure that oil from the clutch chamber 2*p* housing the clutch 47 (refer to FIG. 2) does not splash out.

Figure 6:
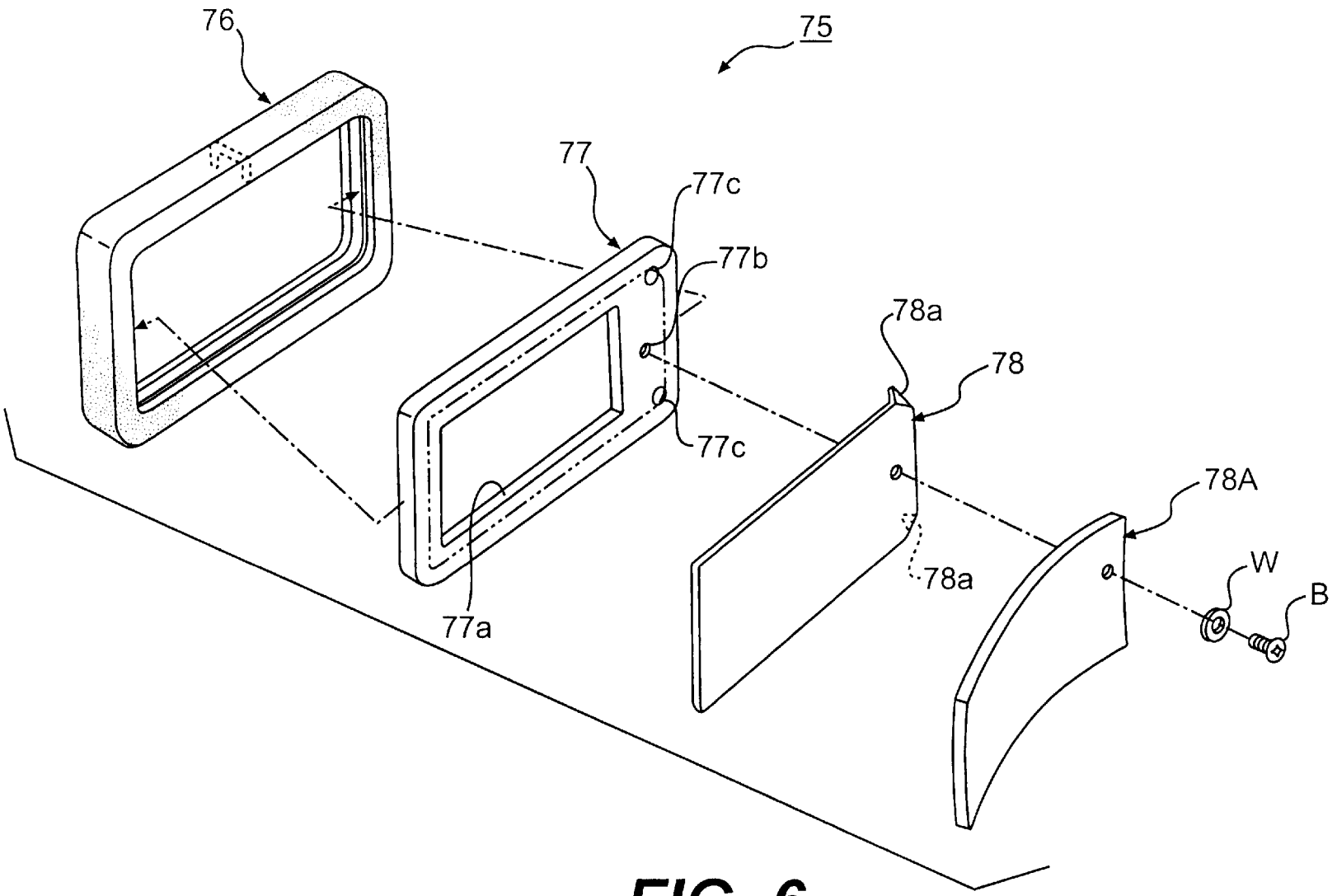
FIG. 6 is a perspective view of a reed valve of the present invention.

FIG. 6 is a perspective view of a reed valve of the present invention. The reed valve 75 comprises a frame-shaped seal member 76 that is inverse C-shaped in cross-section, a valve base 77 that fits into the seal member 76, a reed 78 attached to the valve base 77 and a stopper 78A for limiting the extent to which the reed 78 opens. A rubber or soft resin is suitable for the seal member 76.

The valve base 77 is equipped with an opening 77*a* for oil to pass through, a screw portion 77*b* into which a screw B is screwed via a washer W in order to attach the reed 78, and holes 77*c* and 77*c* for preventing the reed 78 from turning.

The reed 78 is a thin spring plate equipped with bent portions 78*a* and 78*a* provided at corners thereof for insertion into the holes 77*c* and 77*c* for preventing the valve base 77 from turning.

Figure 7:
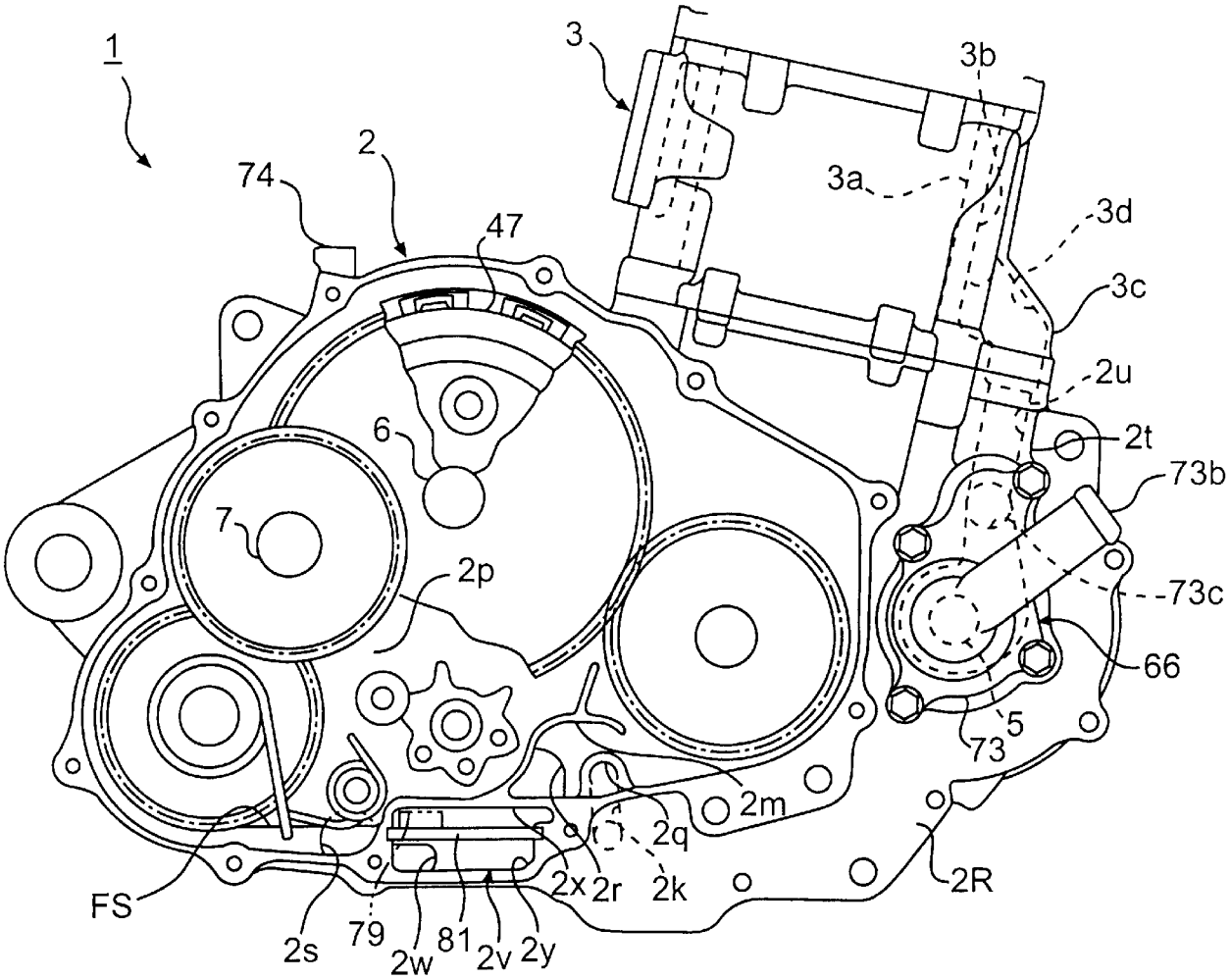
FIG. 7 is a side view from the other side of the engine of the present invention.

FIG. 7 is a side view taken from the other side of the engine of the present invention and, for the sake of convenience, the case side cover 53 (refer to FIG. 2 and FIG. 5) is removed.

The crankcase 2R is equipped with a cooling water pipe 2*u* for allowing cooling water to flow within the side wall 2*t* substantially above the balancer shaft 5.

The crankcase 2R is equipped with a first path 2*r* and a second path 2*s* communicating with the transmission chamber 2T (refer to FIG. 4) from the side of the clutch chamber 2*p* and an oil strainer chamber 2*v* communicating with an inlet port 79 of the first oil pump (refer to FIG. 2). FS is the surface of oil accumulated in the clutch chamber 2*p* and the transmission chamber 2T when the engine is running.

The oil strainer chamber 2*v* is equipped with a third path 2*w* communicating with the transmission chamber 2T, and a screen 81 arranged in such a manner as to divide the oil strainer chamber 2*v* into an upper chamber 2*x* and a lower chamber 2*y* and for removing foreign bodies, etc. from the circulating oil. The inlet port 79 of the first oil pump 24 is provided at the case side cover 53, so as to face the upper chamber 2*x*.

The cylinder block 3 is equipped with a front water cooling path 3*d* formed in a thickened side wall 3*c* communicating with a water jacket 3*b* within the side wall 3*c*. A water pump 66 is equipped with an inlet pipe 73*b* communicating with the side of a radiator (not shown) at the case section 73. Furthermore, an outlet hole 73*c* for discharging cooling water from the case section 73 and communicating with the cooling water path 2*u* of the crankcase 2R is provided.

The operation of the four-cycle engine lubrication structure will now be described.

Figure 8A:
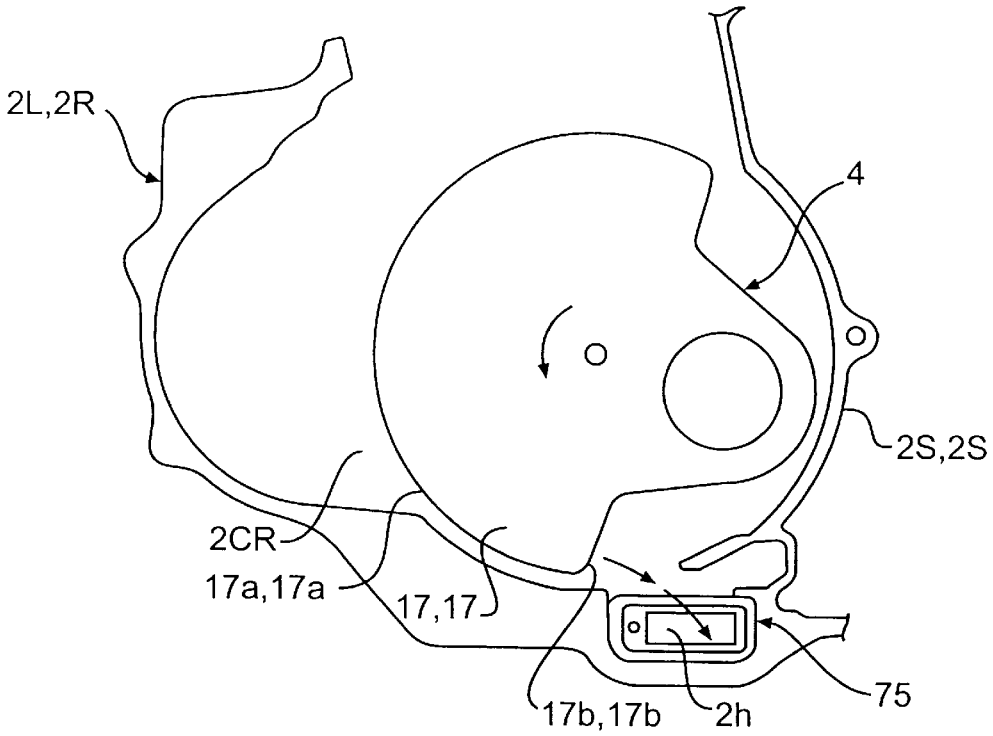
FIGS. 8(*a*) and 8(*b*) are first operational diagrams illustrating the operation of the four-cycle engine lubrication structure of the present invention.
Figure 8B:
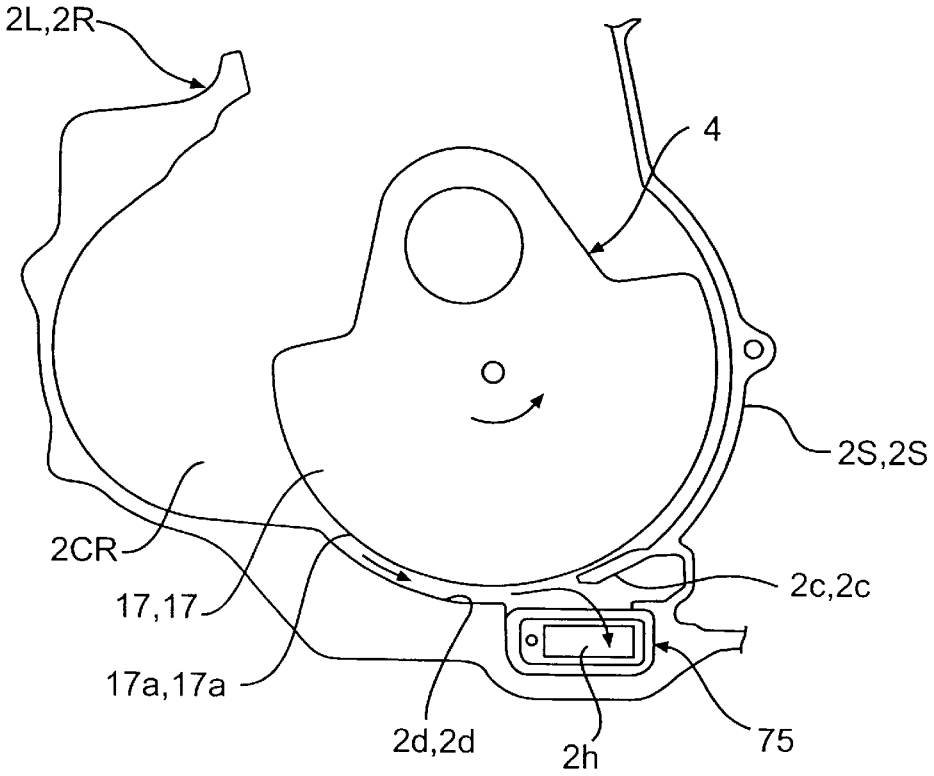

FIG. 8(*a*) and FIG. 8(*b*) are first operation diagrams for describing the operation of the four-cycle engine lubrication structure of the present invention.

In FIG. 8(*a*), when the crankshaft 4 rotates in the direction of the arrow, oil within the crank chamber 2CR is pushed out by the straight portions 17*b* and 17*b* of the counterweights 17 and 17 so as to flow into the oil sump 2*h* as shown by the arrows.

As shown in FIG. 8(*b*), when the crankshaft 4 rotates further, oil sticks to the outer surfaces 17*a* and 17*a* of the counterweights 17 and 17. Furthermore, oil that has been made to flow by the rotation of the counterweights 17 and 17 in a path between the counterweights 17 and 17 and the wall surfaces 2*d* and 2*d* of the crankcases 2R and 2L is removed by the projections 2*c* and 2*c* and flows into the oil sump 2*h* as shown by the arrows.

Figure 9:
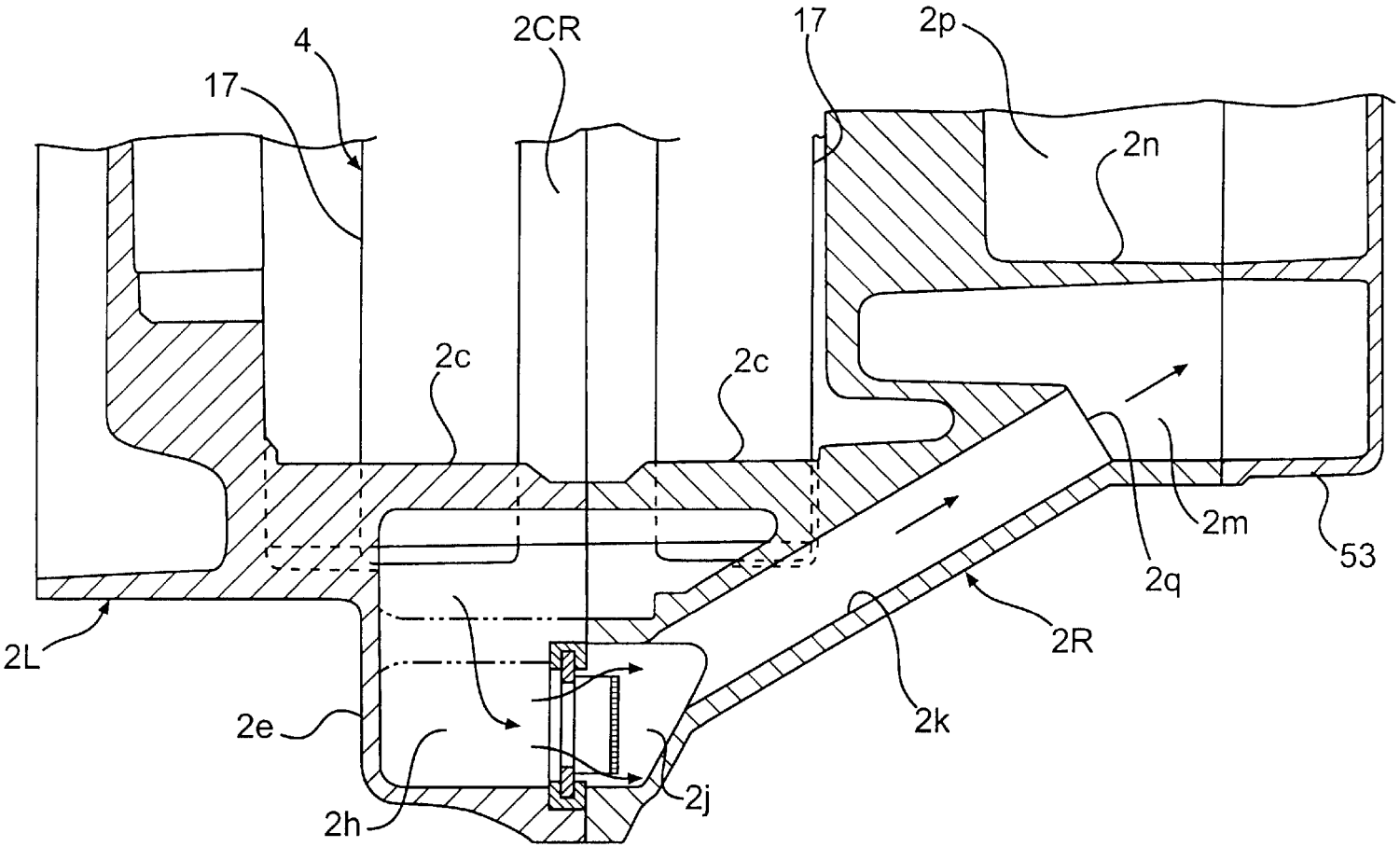
FIG. 9 is a second operational diagram illustrating the operation of the four-cycle engine lubrication structure of the present invention.

FIG. 9 is a second operation diagram illustrating the operation of the four-cycle engine lubrication structure of the present invention.

When the pressure within the crank chamber 2CR becomes high and the reed valve 75 opens due to fluctuations within the crank chamber 2CR, oil that has flowed into the oil sump 2*h* flows into the oil inflow chamber 2*j* on the side of the crankcase 2R, flows through the oil passage 2*k* and is discharged from the outlet 2*q* of the oil passage 2*k* to the oil chamber 2*m*.

Figure 10:
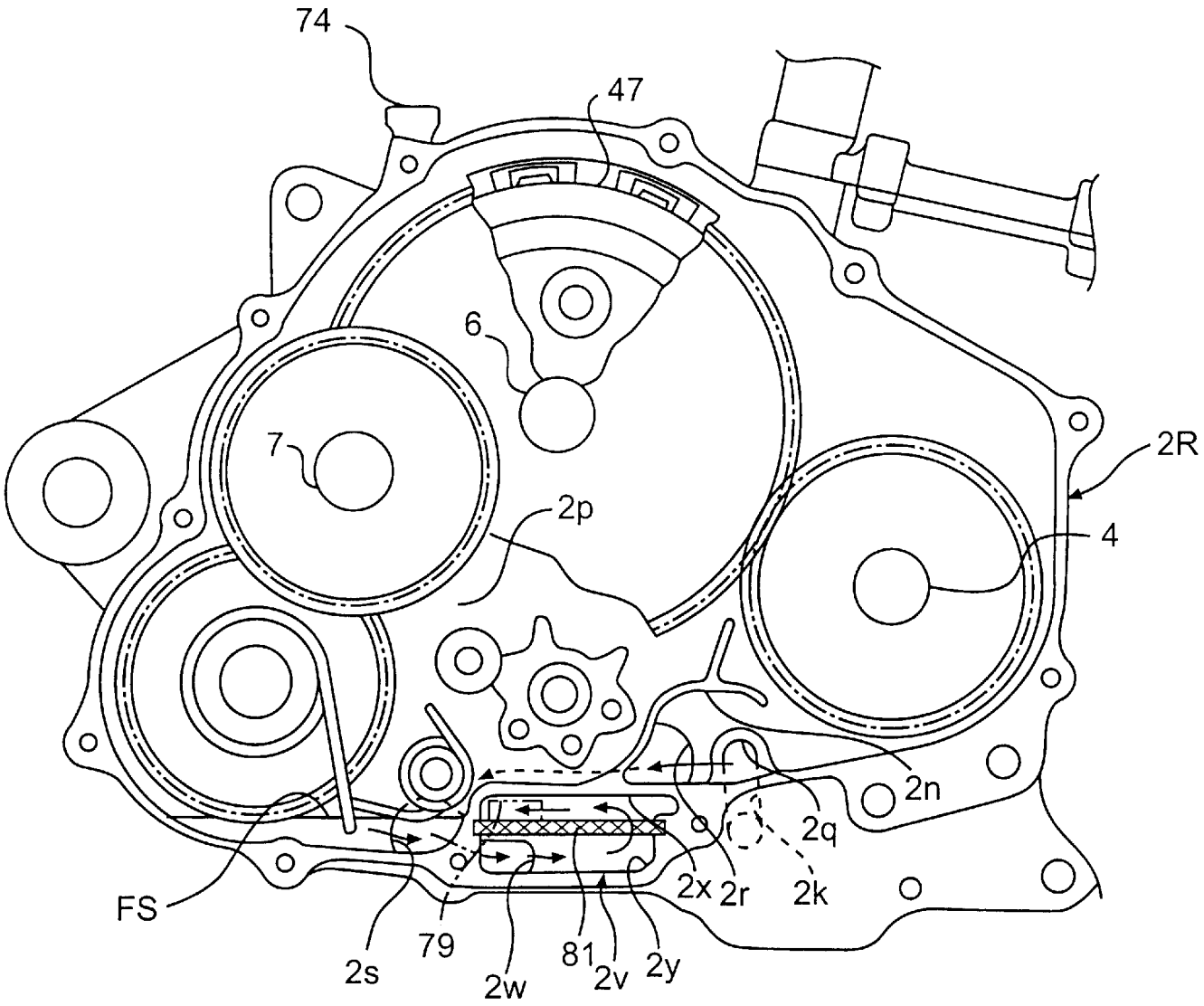
FIG. 10 is a third operational diagram illustrating the operation of the four-cycle engine lubrication structure of the present invention.

FIG. 10 is a third operational diagram illustrating the operation of the four-cycle engine lubrication structure of the present invention.

Oil discharged from the outlet 2*q* of the oil passage 2*k* then flows into the transmission chamber 2T (refer to FIG. 4) via the first path 2*r* and is then collected at the lower part of the transmission chamber 2T and the lower part of the clutch chamber 2*p* communicating with the transmission chamber 2T via the second path 2*s*.

This collected oil then flows into the lower chamber 2*y* of the oil strainer chamber 2*v* via the third path 2*w*, reaches the upper chamber 2*x*, flows up from the inlet port 79 of the first oil pump 24 (refer to FIG. 2) into an oil tank (not shown) and is supplied from the oil tank to each part of the engine using the second pump 25 (refer to FIG. 2).

Since the outlet 2*q* of the oil passage 2*k* is provided above the level of the oil surface FS of the oil collected in the transmission chamber 2T and the clutch chamber 2*p*, oil is smoothly discharged from the outlet 2*q* of the oil passage 2*k* without being discharged into the collected oil.

Further, oil mixed with air due to the rotations of the crankshaft 4 (refer to FIG. 8(*a*)), etc. exists within the crank chamber 2CR (refer to FIG. 8(*a*)) and is discharged from the crank chamber 2CR via the reed valve 75 (refer to FIG. 9). However, this oil is not mixed directly with the collected oil and oil oxidation is therefore prevented. Moreover, since there is no direct contact with high-temperature blow-by gas, etc. deterioration of the oil is suppressed.

Still further, since the cover 2*n* is provided at the oil chamber 2*m* shown in FIG. 9, oil does not splash out directly to the oil chamber 2*m* when the clutch 47 (refer to FIG. 7)

rotates and a large quantity of oil with air mixed therein does not flow into the oil chamber 2*m*. The oil is therefore prevented from oxidation and deterioration of the oil can be prevented. Moreover, since oil does not enter into the outlet 2*q* of the oil passage 2*k*, there is no substantial resistance at the time of oil discharge.

The present invention brings about the following results with the above configuration.

The four-cycle engine lubrication structure of the present invention is provided with an oil sump at a lower part of a crank chamber, a reed valve provided at an outlet of the oil sump, and an oil passage extending at an incline upwards from the outlet of the oil sump, with an outlet of the oil passage being provided above an oil surface level of oil accumulated within the engine. Oil from the outlet of the oil passage is therefore not discharged within collected oil and oil is discharged from the outlet of the oil passage without resistance. Furthermore, oil mixed with air within the crank chamber is not mixed directly with collected oil. Oxidation of the oil is therefore prevented and since there is no direct contact with high-temperature blow-by gas, etc. oil deterioration is suppressed.

According to the present invention, projections are formed at the crank chamber inner wall of the inlet for the oil sump and oil on the weights can therefore be removed by these projections and be made to flow quickly to the oil sump, while oil can be discharged more easily from within the crank chamber.

Sufficient oil can therefore be supplied in a rapid manner to places within the engine requiring lubrication.

The four-cycle engine lubrication structure of the present invention is provided with an oil chamber for separating and collecting oil from oil mist discharged at the outlet of the oil passage. Air bubbles are therefore no longer mixed with the collected oil and oil deterioration is prevented so that oil supplied to each part of the engine can be effectively utilized. Furthermore, the outlet of the oil passage is protected and discharge of oil from the crank chamber is improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A four-cycle engine lubrication structure for lubricating an engine and transmission with a common lubricating oil, comprising:

an oil sump for lubricating oil provided at a lower part of a crank chamber of a four-cycle engine;

a reed valve provided at an outlet of the oil sump, said reed valve being openable when pressure in the crank chamber is high; and an oil passage sloping upwards from the outlet of the oil sump, an outlet of the oil passage being provided above a surface level of oil accumulated within a bottom part of a transmission chamber of the transmission.

2. The four-cycle engine lubrication structure according to claim 1, wherein projections are formed on an inner wall of the crank chamber at an inlet of the oil sump, said projections project along an outer periphery of a crankshaft weight in an opposite direction to a direction of rotation of the crankshaft weight, said projections come into contact with the outer periphery of the crankshaft weight upon rotation of the crankshaft weight.

3. The four-cycle engine lubrication structure according to claim 2, further comprising an oil chamber located at the oil passage outlet for separating and recovering oil from oil mist discharged from the oil passage outlet.

4. The four-cycle engine lubrication structure according to claim 3, further comprising a cover covering the oil chamber for preventing oil from splashing out of a clutch chamber of the engine into the oil chamber when a clutch of the engine rotates.

5. The four-cycle engine lubrication structure according to claim 1, further comprising an oil chamber located at the oil passage outlet for separating and recovering oil from oil mist discharged from the oil passage outlet.

6. The four-cycle engine lubrication structure according to claim 5, further comprising a cover covering the oil chamber for preventing oil from splashing out of a clutch chamber of the engine into the oil chamber when a clutch of the engine rotates.

7. The four-cycle engine lubrication structure according to claim 1, wherein said reed valve further comprises:

a frame shaped seal member having an inverse C-shaped cross-section;

a valve base located adjacent the seal member;

a reed attached to the valve base; and a stopper for limiting the extent to which the reed opens.

8. The four-cycle engine lubrication structure according to claim 7, wherein the reed includes bent portions provided at corners thereof for inserting into holes formed in the valve base.

9. A four-cycle engine having a lubricating structure for lubricating said engine and a transmission with a common lubricating oil, comprising:

a crank chamber;

an oil sump for lubricating oil provided at a lower part of the crank chamber of the four-cycle engine;

a reed valve provided at an outlet of the oil sump, said reed valve being openable when pressure in the crank chamber is high; and an oil passage sloping upwards from the outlet of the oil sump, an outlet of the oil passage being provided above a surface level of oil accumulated within a bottom part of a transmission chamber of the transmission.

10. The four-cycle engine according to claim 9, further comprising a crankshaft weight mounted for rotation in the four-cycle engine, and wherein projections are formed on an inner wall of the crank chamber at an inlet of the oil sump, said projections project along an outer periphery of the crankshaft weight in an opposite direction to a direction of rotation of the crankshaft weight, said projections come into contact with the outer periphery of the crankshaft weight upon rotation of the crankshaft weight.

11. The four-cycle engine according to claim 10, further comprising an oil chamber located at the oil passage outlet for separating and recovering oil from oil mist discharged from the oil passage outlet.

12. The four-cycle engine lubrication structure according to claim 11, further comprising a cover covering the oil chamber for preventing oil from splashing out of a clutch chamber of the engine into the oil chamber when a clutch of the engine rotates.

13. The four-cycle engine according to claim 9, further comprising an oil chamber located at the oil passage outlet for separating and recovering oil from oil mist discharged from the oil passage outlet.

14. The four-cycle engine according to claim 13, further comprising a cover covering the oil chamber for preventing oil from splashing out of a clutch chamber of the engine into the oil chamber when a clutch of the engine rotates.

15. The four-cycle engine lubrication structure according to claim 9, wherein said reed valve further comprises:

a frame shaped seal member having an inverse C-shaped cross-section;

a valve base located adjacent the seal member;

a reed attached to the valve base; and a stopper for limiting the extent to which the reed opens.

16. The four-cycle engine lubrication structure according to claim 15, wherein the reed includes bent portions provided at corners thereof for inserting into holes formed in the valve base.

17. A four-cycle engine having a transmission which is lubricated with a common lubricating oil, comprising:

a pair of crankcases, said pair of crankcases being partitioned into a crank chamber and a transmission chamber;

an oil sump for the common lubricating oil provided at a lower part of said crank chamber;

a reed valve provided at an outlet of the oil sump, said reed valve being openable when pressure in the crank chamber is high; and an oil passage sloping upwards from the outlet of the oil sump, an outlet of the oil passage being provided above a surface level of oil accumulated in a bottom part of the transmission chamber.

18. The four-cycle engine lubrication structure according to claim 17, wherein projections are formed on an inner wall of the crank chamber at an inlet of the oil sump, said projections project along an outer periphery of a crankshaft weight in an opposite direction to a direction of rotation of the crankshaft weight, said projections come into contact with the outer periphery of the crankshaft weight upon rotation of the crankshaft weight.

19. The four-cycle engine lubrication structure according to claim 18, further comprising an oil chamber located at the oil passage outlet for separating and recovering oil from oil mist discharged from the oil passage outlet.

20. The four-cycle engine lubrication structure according to claim 19, further comprising a cover covering the oil chamber for preventing oil from splashing out of a clutch chamber of the engine into the oil chamber when a clutch of the engine rotates.

21. The four-cycle engine lubrication structure according to claim 17, further comprising an oil chamber located at the oil passage outlet for separating and recovering oil from oil mist discharged from the oil passage outlet.

22. The four-cycle engine lubrication structure according to claim 21, further comprising a cover covering the oil chamber for preventing oil from splashing out of a clutch chamber of the engine into the oil chamber when a clutch of the engine rotates.

23. The four-cycle engine lubrication structure according to claim 17, wherein said reed valve further comprises:

a frame shaped seal member having an inverse C-shaped cross-section;

a valve base located adjacent the seal member;

a reed attached to the valve base; and a stopper for limiting the extent to which the reed opens.

24. The four-cycle engine lubrication structure according to claim 23, wherein the reed includes bent portions provided at corners thereof for inserting into holes formed in the valve base.

* * * * *